US006692257B1

(12) United States Patent
Branum et al.

(10) Patent No.: US 6,692,257 B1
(45) Date of Patent: Feb. 17, 2004

(54) APPARATUS AND METHOD TO TEACH BASEBALL AND SOFTBALL BASE SLIDING TECHNIQUES TO CHILDREN

(76) Inventors: Celeste Branum, 14455 Courtney Rd., Walker, LA (US) 70785; Troy Buckley, 14455 Courtney Rd., Walker, LA (US) 70785; Angela Achord, 14455 Courtney Rd., Walker, LA (US) 70785

( * ) Notice: Subject to any disclaimer, the term of this patent is extended or adjusted under 35 U.S.C. 154(b) by 0 days.

(21) Appl. No.: 10/389,568

(22) Filed: Mar. 17, 2003

(51) Int. Cl.[7] ..... A63B 69/00

(52) U.S. Cl. ..... 434/247; 434/255; 472/117; 473/451

(58) Field of Search ..... 472/116, 117, 472/128, 137; 473/422, 451; 434/247, 251, 255, 252

(56) References Cited

U.S. PATENT DOCUMENTS 2,982,547 A 5/1961 Carrier
4,762,316 A 8/1988 Merino
4,887,811 A * 12/1989 Tresh ..... 473/451
RE34,042 E 8/1992 Merino
5,551,922 A 9/1996 Katz et al.
5,639,084 A * 6/1997 Kawasaki ..... 473/421
5,669,822 A 9/1997 Smollar et al.
5,676,602 A 10/1997 Katz et al.
6,062,983 A 5/2000 Butsook
6,312,341 B1 11/2001 Healy

* cited by examiner

*Primary Examiner*—Kien T. Nguyen
(74) *Attorney, Agent, or Firm*—John D. Gugliotta; Olen L. York, III

(57) ABSTRACT

A water sliding baseball game is a water-based baseball or softball game. The game may be played according to the general rules of baseball or softball, but includes enhancements to incorporate the use of water, thus allowing sliding and increased fun, while also reducing the risk of injury and pain associated with repeated sliding into bases on grass or dirt surfaces. The game is played on a vinyl tarp having a substantially square playing area and substantially conforming to the terrain or surface over which it is placed. The bases are made of a non-absorbent material. Tubing, with multiple water ports, is routed along the baselines and hooked up to a garden hose. When the water is turned on, it provides a gentle spray all over the infield and outfield areas, thereby providing the proper conditions for instructing on base sliding skills, with the spraying water facilitating base sliding.

19 Claims, 7 Drawing Sheets

APPARATUS AND METHOD TO TEACH BASEBALL AND SOFTBALL BASE SLIDING TECHNIQUES TO CHILDREN

RELATED APPLICATIONS AND DISCLOSURES

The present invention was first described in Disclosure Document Registration 509,493 filed on Apr. 8, 2002 under 35 U.S.C. §122, 37 C.F.R. §1.14 and MPEP §1706. There are no previously filed, nor currently any co-pending applications, anywhere in the world.

BACKGROUND OF THE INVENTION

1. Field of the Invention

The present invention relates generally to water slides, and, more particularly, to a substantially flat water slide configured to instruct children on the appropriate techniques for sliding into bases in relation to baseball and/or softball.

2. Description of the Related Art

Baseball and softball have remained a popular form of entertainment, thereby popularizing participation in the sport. Baseball and/or softball requires many skills to achieve success and fulfillment. One of these skills is that of sliding into a base. In fact, many games have been won as the result of a carefully executed slide. However, the skill of sliding is a difficult one to teach to younger children, who find it difficult to intentionally slide on the side of a leg on grass or dirt. The sliding drills common in a practice session increase the risk of injury to the participating children. Furthermore, the repetitive nature of fundamental drills often bore children and making the activity more of a chore rather than a fun learning experience. Accordingly, there is a need for a means by which the skill of sliding in baseball and/or softball can be taught in a fun, easy and entertaining manner.

A search of the prior art did not disclose any patents that read directly on the claims of the instant invention; however, the following references were considered related:

U.S. Pat. No. 6,312,341, issued in the name of Healy, discloses a water slide with cushioning, wherein the slide has a series of three tubes, a first series for cushioning the impact on landing, a second series positioned along the lateral periphery of the slide to act as a bumper, and a third series to permit water to be sprayed onto the sliding surface;

U.S. Pat. No. 6,062,983, issued in the name of Butsook, discloses a combination water slide and pool, including an elongated sliding sheet affixed to a peripheral sidewall comprising the pool portion;

U.S. Pat. Nos. 5,676,602 and 5,551,922, both issued in the name of Katz et al., discloses a toy water slide comprising an elongated sliding sheet affixed to an inflatable sidewall forming the pool, wherein the pool portion includes a serpentine pathway for added thrills and excitement;

U.S. Pat. No. 5,669,822, issued in the name of Smollar et al., discloses a water slide comprising an elongated sliding portion that is affixed to a small pool portion, wherein a user slides along the sliding portion and over a ramp into the filled pool;

U.S. Pat. No. Re. 34,042, a reissue patent of U.S. Pat. No. 4,762,316, issued in the name of Merino, discloses a wave surfing simulation apparatus comprising an elongated water slide having a plurality of transverse chambers to provide an undulating effect on a slider; and U.S. Pat. No. 2,982,547, issued in the name of Carrier, discloses a portable aquatic play device having a flexible film strip connected to an irrigation source for reducing the friction on the flexible film.

Consequently, a need has been felt for providing an apparatus and method which overcomes the problems cited above.

SUMMARY OF THE INVENTION

It is therefore an object of the present invention to provide an elongated base sliding apparatus comprising a slippery playing surface to facilitate teaching and enjoyment in base sliding instruction.

It is another object of the present invention to provide a base sliding apparatus having a diamond indicia similar to that of a baseball and/or softball diamond (infield).

It is another object of the present invention to provide a base sliding apparatus having at least a home base and a pitching rubber (or pitching indicia) that are integral to the playing surface.

It is another object of the present invention to provide a base sliding apparatus having bases filled with a padded interior to lessen the risk of injury to participants.

It is another object of the present invention to provide a base sliding apparatus having a lubricating conduit linearly elongated about a quadrilateral shape having four equal sides and angles, wherein the lubricating conduit circulates lubricating means for providing enhanced slipping conditions.

It is yet another object of the present invention to provide a base sliding apparatus having an inlet port for connection to a source of the lubricating means.

It is still another object of the present invention to provide a base sliding apparatus having a plurality of integral weights for providing a securing effect on the playing surface, so as to prevent unnecessary movement of the playing surface caused by the activity, the wind or other environmental concerns.

Briefly described according to one embodiment of the present invention, a water sliding baseball game is a water-based baseball or softball game. The game is played according to the general rules of baseball or softball, but includes enhancements to incorporate the use of water, thus allowing sliding and increased fun, while also reducing the risk of injury and pain associated with repeated sliding into bases on grass or dirt surfaces. The game is played on a vinyl tarp having a substantially square playing area and substantially conforming to the terrain or surface over which it is placed. The bases are made of a non-absorbent mesh material. Tubing, with multiple water ports, is routed along the baselines and hooked up to a garden hose. When the water is turned on, it provides a gentle spray all over the infield and outfield areas, thereby providing the proper conditions for instructing on base sliding skills, with the spraying water facilitating base sliding. Using plastic balls and bats, and a batting tee if needed, baseball or softball is played in a normal manner incorporating the water sliding apparatus. The use of the water sliding baseball game provides summer time fun for all ages, while incorporating the favorite pastime of baseball or softball, and teaching sliding skills in a manner that is quick, easy and effective.

Other objects of the present invention include providing a device that is portable, lightweight and easily maintained.

Still other objects of the present invention include the inclusion of plastic bats and balls to provide a complete kit of a modified baseball or softball game.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 8*d*.

1. Detailed Description of the Figures

Figure 1:
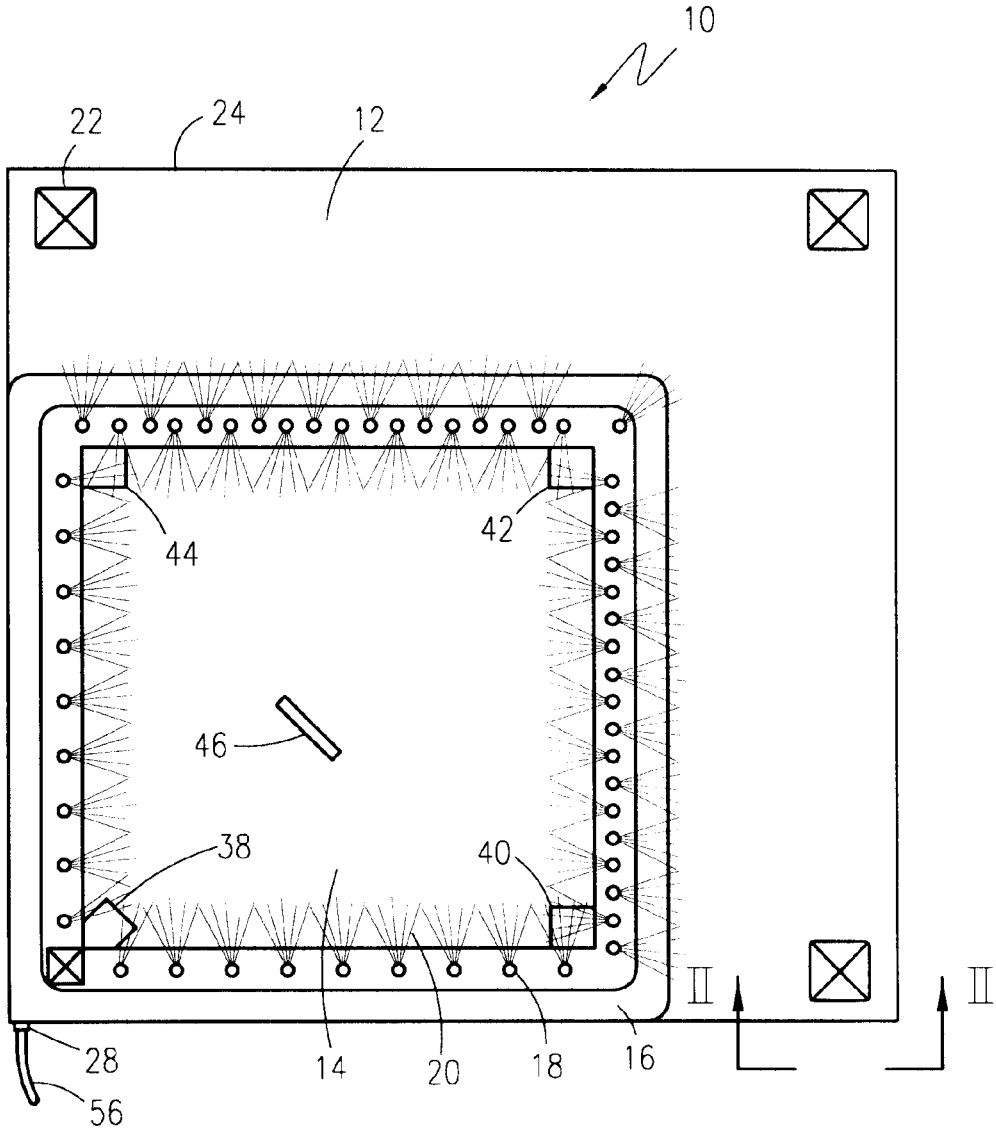
FIG. 1 is a plan view of the teaching apparatus that includes diamond indicia on the playing surface and a conduit for circulating lubricating means.

Referring now to FIG. 1, an apparatus for teaching baseball and softball base sliding techniques 10 is shown in accordance with the preferred embodiment of the present invention. The apparatus 10 is an elongated playing surface 12 that includes baseball and/or softball diamond indicia 14 arranged atop the playing surface 12. A lubricating conduit 16 is bound to the playing surface 12 having a plurality of pin holes 18 for circulation of lubricating means 20. The conduit 16 is linearly elongated about four-sides so as to substantially circumscribe and substantially form a square about the diamond indicia 14. A plurality of weights 22 are arranged about a perimeter 24 of the playing surface 12 to provide anchoring to the terrain the playing surface 12 is secured to. An inlet port 28 is integral to the conduit 16 so as to provide a means of connecting the source 30 of the lubricating means 20.

Figure 2:
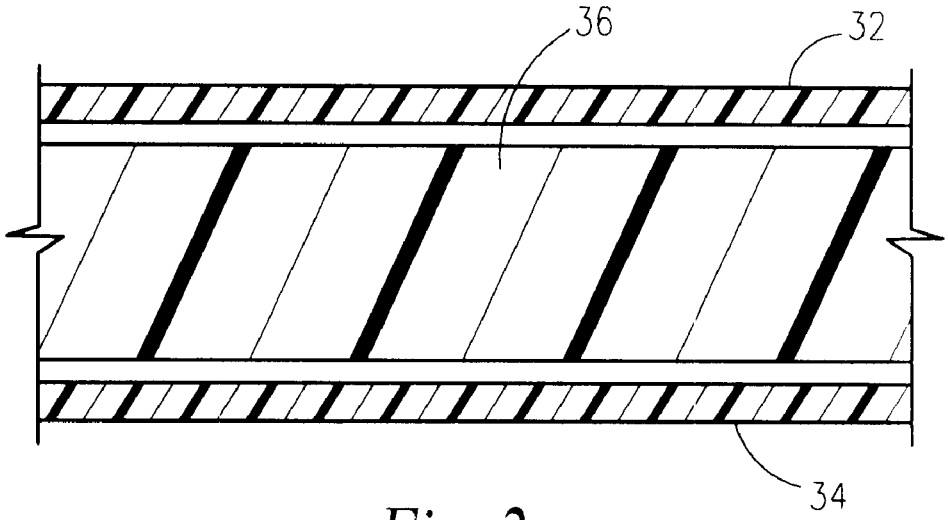
FIG. 2 is a cross-section view of an alternative embodiment of the playing surface described by FIG. 1, taken along the line II—II and illustrating the cushioning member that lies between a top layer and a bottom layer of the playing surface.
Figure 3:
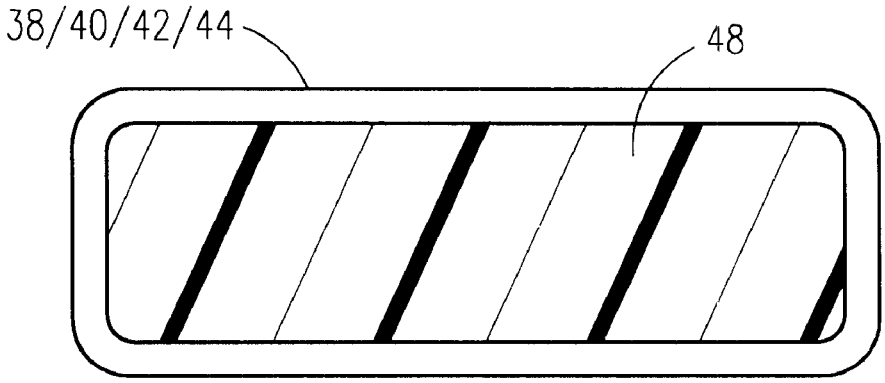
FIG. 3 is a partial sectional and cutaway side view of a base illustrating the padded interior of the base.
Figure 4:
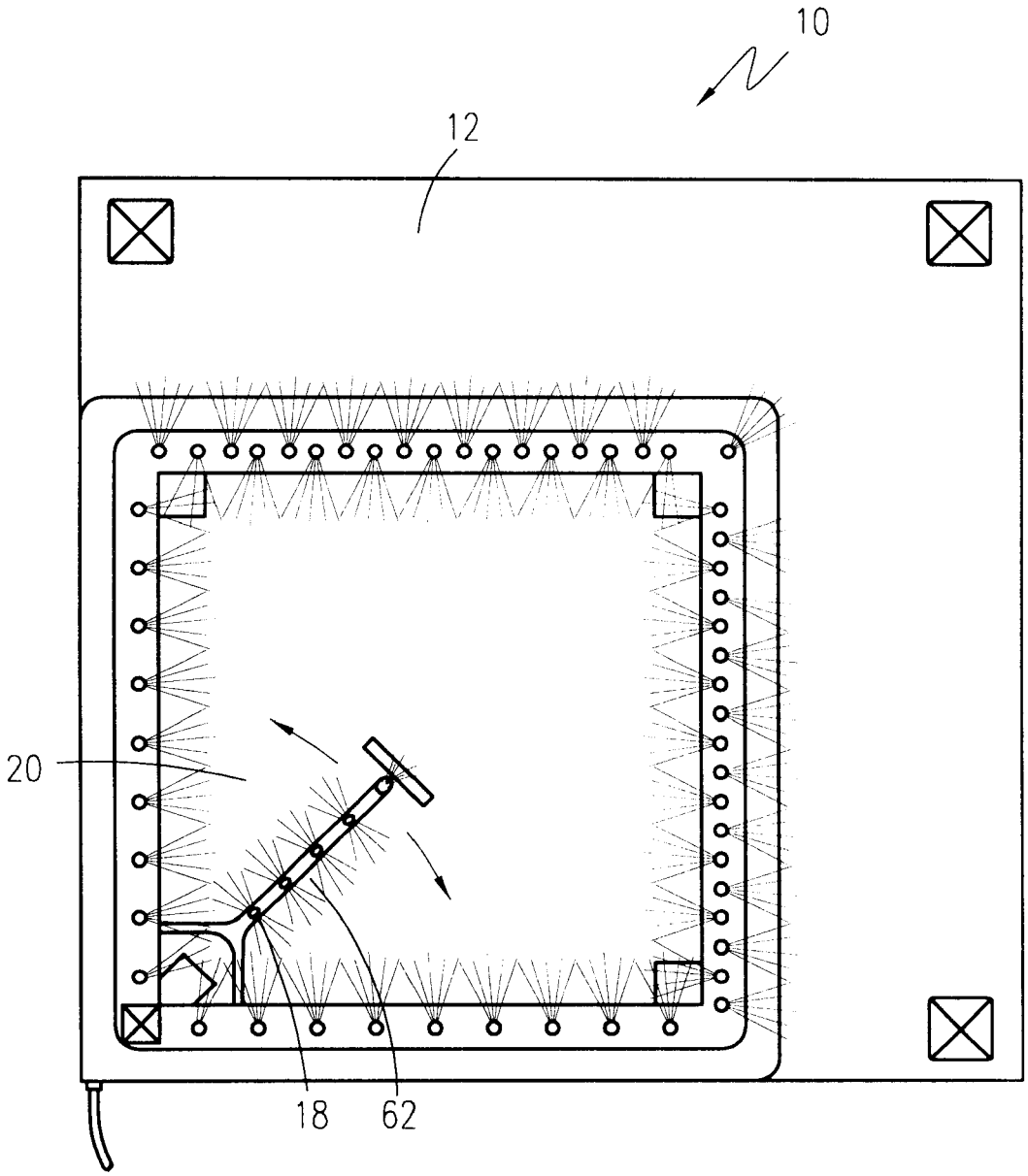
FIG. 4 is a top plan view of an alternative embodiment of the apparatus described by FIG. 1 in which a second conduit is provided that runs along a linear line between home base and the pitching rubber (or pitching indicia)
Figure 5A:
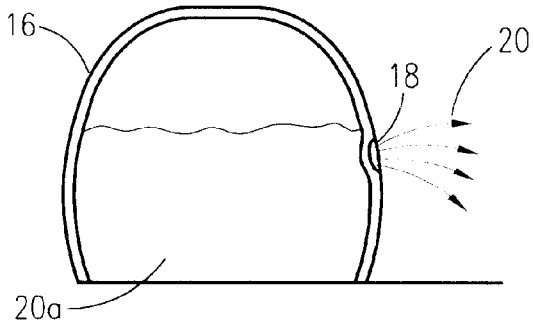
FIG. 5*a* is a partial cutaway side view of the conduit illustrating the pin hole in spatial relationship to the lubricating means circulated therethrough.
Figure 5B:
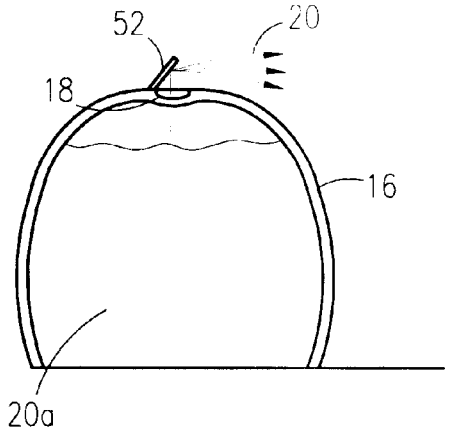
FIG. 5*b* is a partial cutaway side view of the conduit illustrating the pin hole in spatial relationship to the lubricating means and having a directional baffle aligned about the pin hole to provide directional control and to provide a spraying or misting effect.
Figure 6A:
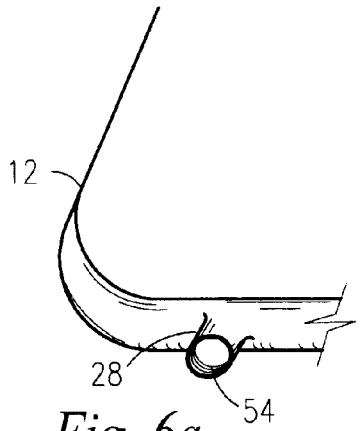
FIG. 6*a* is a perspective view of the playing surface to illustrate one embodiment of the inlet port having internal threads for coupling to the external threads of a lubricating means source.
Figure 6B:
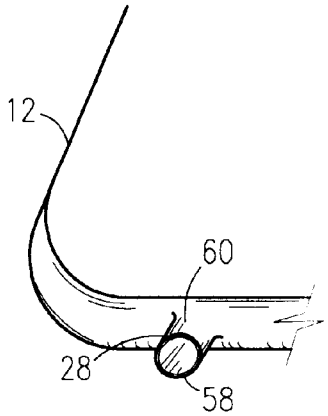
FIG. 6*b* is a perspective view of the playing surface to illustrate an alternative embodiment of the inlet port having a tapered orifice, wherein the mouth is wide and narrows to a tip.
Figure 7:
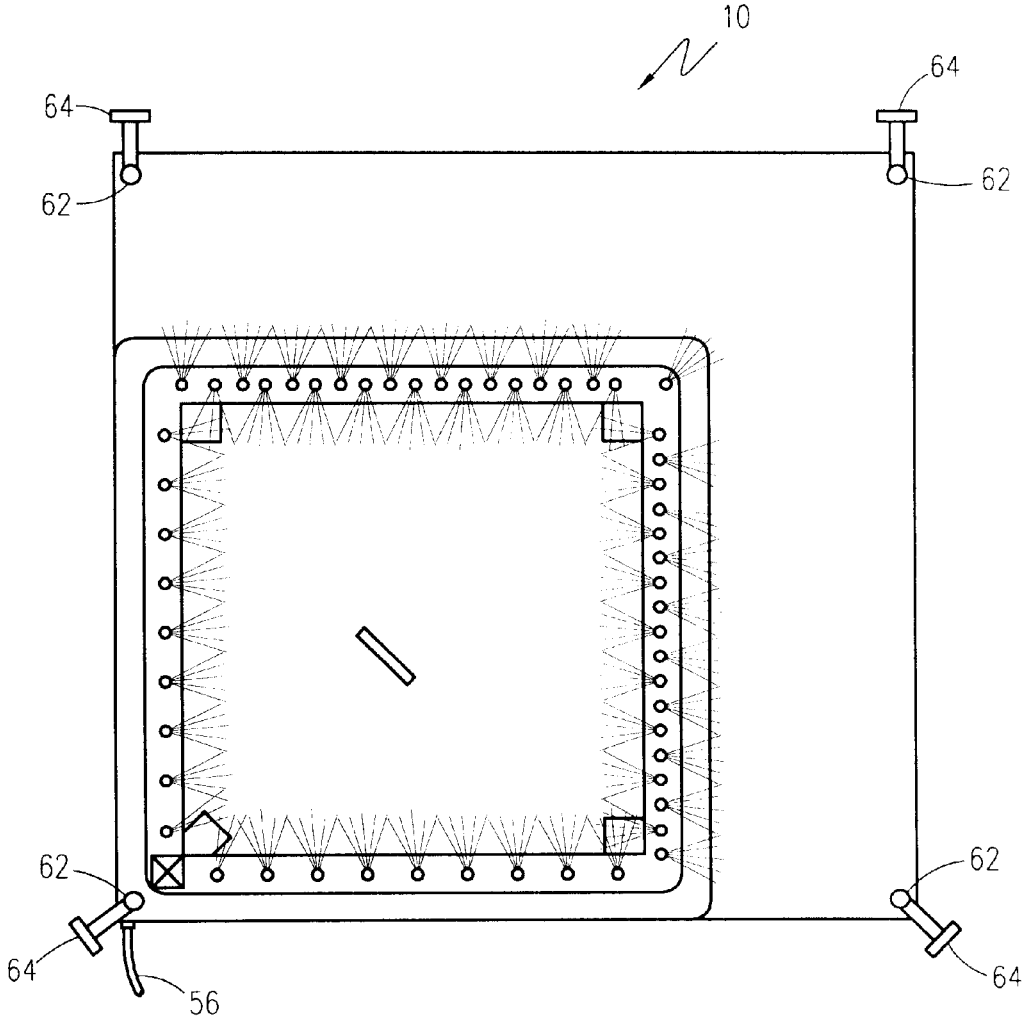
FIG. 7 is a plan view of an alternative embodiment of the apparatus described by FIG. 1 wherein the apparatus includes a plurality of eyelets for securing the playing surface to a surface, as opposed to the integral weights described by FIG. 1.
Figure 8A:
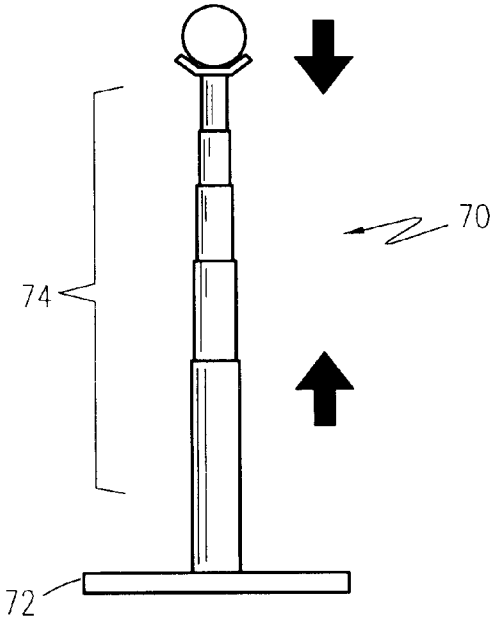
FIG. 8*a* is a side view of a telescopic tee for hitting a ball therefrom.
Figure 8B:
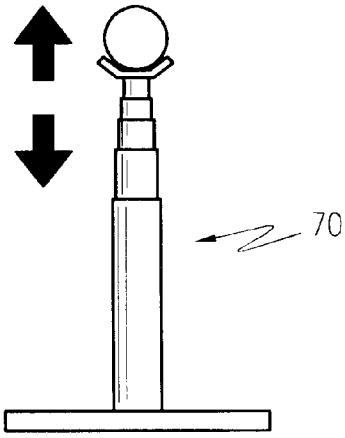
FIG. 8*b* is a side view of a telescopic tee with the stem length reduced to accommodate a batter of a smaller size.
Figure 8C:
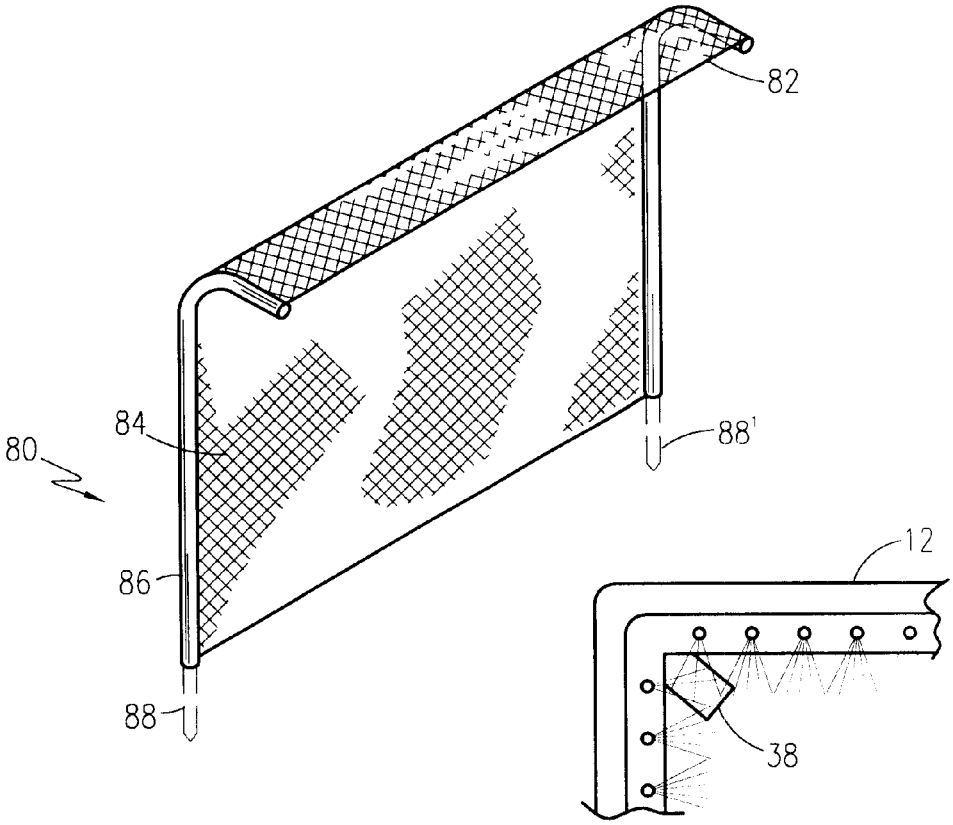
FIG. 8*c* is a perspective view of a net positioned behind home base and the playing surface to serve as a backstop for pitched balls.
Figure 8D:
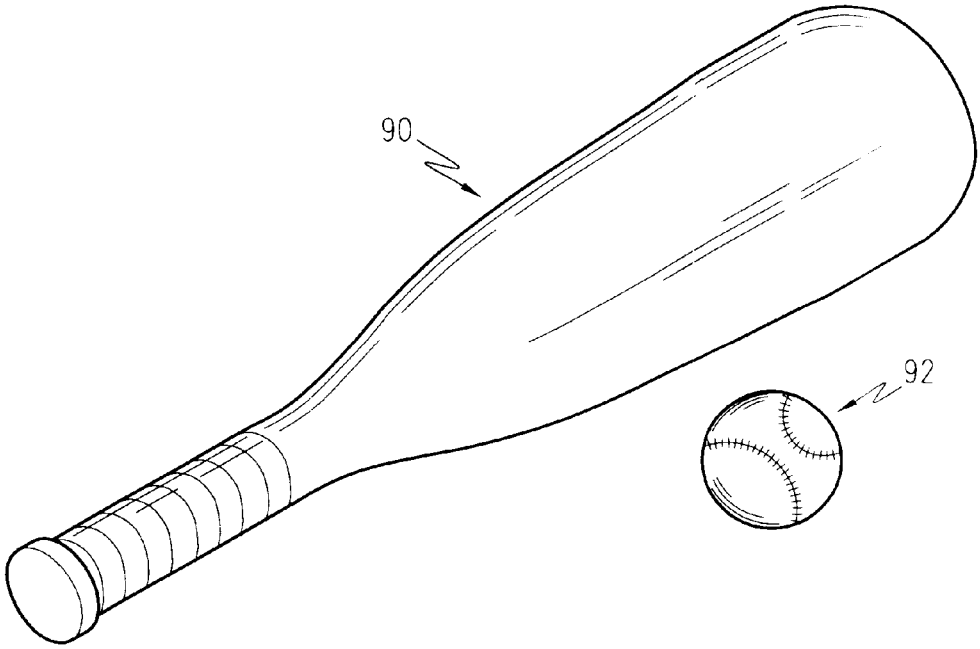
FIG. 8*d* is a perspective view of a bat and ball used with teaching apparatus.

The elongated playing surface 12 may be arranged in a variety of shapes and/or forms, including the substantially square surface depicted in FIG. 1 and FIG. 2. It is envisioned that the playing surface 12 might also be arranged in a rectangular manner. So long as the playing surface 12 has sufficient area to include the diamond indicia 14, the size and shape may be of any suitable arrangement. The playing surface 12 may be a single layer of flexible plastic such as polyethylene or vinyl reinforced with elastomers to provide added structural strength. The plastic composition of the playing surface 12 provides a slippery surface upon which participants slide on. In an alternative embodiment, and as depicted in FIG. 2, the playing surface 12 may comprise two layers of flexible plastic, a top layer 32 and a bottom layer 34, and with a cushioning member 36 therebetween. The top layer 32 is affixed to the bottom layer 34 by machine stitching, adhesive or other appropriate affixing means. The cushioning member 36 is provided between the top layer 32 and bottom layer 34 for softening the impact of participants as each slides along the diamond indicia 14, and may be particularly useful and/or necessary if the chosen terrain is uneven or includes several rocks or other natural impediments to which a participant might be injured by. The cushioning member 36 may comprise a variety of materials including air, gel, foam, buckwheat or a host of other similar materials.

Referring to FIG. 1, the diamond indicia 14 comprises a home base 38, a first base 40, a second base 42, a third base 44 and a pitching rubber 46 arranged to conform to the general rules and guidelines of LITTLE LEAGUE BASEBALL® or softball, herein incorporated by reference except where inconsistent with the dimensional requirements and game modifications described within. For purposes of clarity only, the rules of baseball and/or softball arrange the aforementioned bases in a diamond-shaped pattern, with home base 38 adjacent to first base 40 and third base 44, and opposite to second base 42, wherein home base 38 is equidistant from first base 40 and third base 44, but the distance between home base 38 and second base 42 is approximately forty percent (40%) greater than the distance between home base 38 and first or third base 40 and 44. Starting at home base 38, the bases are arranged in a counterclockwise manner about a diamond-shaped perimeter so that the location corresponds to first base 40, second base 42, third base 44 and back to home base 38, respectively. The pitching rubber 46 is approximately central to the diamond perimeter formed by the bases 38, 40, 42 and 44, wherein the pitching rubber 46 is approximately central to and between home base 38 and second base 42, and the pitching rubber 46 is approximately central between first base 40 and third base 44. Preferably, at least home base 38 and the pitching rubber (or pitching indicia) 46 are integral to the playing surface 12 so that assembly of the apparatus 10 has fewer detachable components. The remaining bases 40, 42 and 44 are detachably removable from the playing surface 12 so as to allow for compactness of the apparatus 10 when not in use, and may be attached and detached by common mechanisms such as VELCRO®, clips, or other similar items. It is also envisioned that all bases 38, 40, 42, and 44 and pitching rubber 46 are integral to the playing surface, thereby requiring significantly less assembly. In the preferred embodiment, all bases 38, 40, 42 and 44 comprise a padded interior 48 (see FIG. 3) for softening the impact of a participant striking a base 38, 40, 42 or 44, wherein the padded interior 48 is enveloped by an exterior made from durable material, such as the flexible plastic. The exterior of the base may be completely plastic or of a mesh material. The lubricating conduit 16 is a tubular conduit linearly elongated about each of four-sides of a quadrilateral, having approximately four sides of equal length, and approximately four equal angles connecting the four sides, respectively. The conduit 16 circumscribes the diamond-shaped perimeter formed by the bases 38, 40, 42 and 44 and is integral to the playing surface 12, either through fabrication, stitching or adhesive of the conduit 12 to the playing surface 12. In an alternative embodiment, the playing surface 12 further includes a second conduit 62 (see FIG. 5) that lies along a linear line between home base 38 and the pitching rubber 46, thereby providing more lubricating means 20 to the playing surface 12. The second conduit 62 is integral to the conduit 16. The conduit 16 includes a plurality of pin holes 18 integral to the conduit 16 (see FIG. 6*a*) for allowing lubricating liquid to saturate the playing surface 12, including the infield and outfield portions thereof. In an alternative embodiment, the plurality of pin holes 18 include a directional baffle 52 (see FIG. 6*b*) to provide a misting or spraying effect, thereby enhancing the playful atmosphere during use of the apparatus 10. The directional baffle 52 may have a variety of shapes and/or sizes so long as the baffle 52 directs the lubricating means 20 toward the base paths 50. The conduit 16 delivers lubricating means 20 to the base paths 50 of the playing surface 12 via the plurality of pin holes 18, thereby providing enhanced sliding conditions for the participants. The lubricating means 20 may include a variety of substances, including water 20*a* or water-based solutions. A non-tearing soap additive may be introduced into the water or water-based solution to provide further enhancements to sliding while also supplying soapy bubbles to the playful atmosphere.

Referring to FIG. 1, FIG. 7*a* and FIG. 7*b*, the inlet port 28 is formed at a margin of the apparatus 10 that is integral to the conduit 16 either through a fabrication process, stitching, adhesive, or other suitable affixing means. The inlet port 28 is in fluid communication with the conduit 16 so that a source 30 of the lubricating means 20 may be removably affixed to the inlet port 28. In one embodiment of the inlet port 28, a series of internal threads 54 are provided to receive the external threads from a connection hose 56. In an alternative embodiment, the inlet port 28 is tapered from a wide mouth opening 58 to a narrowed internal end 60 to mechanically and frictionally impinge the source 30 and/or hose 56.

Referring back to FIG. 1, the plurality of weights 22 are provided about the perimeter of the playing surface 12. The weights 22 are provided to secure the apparatus 10 to a specified area and prevent accidental tripping of participants along the perimeter. The weights 22 may be a variety of materials, although it is envisioned that the weights 22 are solid in form and comprising a material heavier in mass than the material of the playing surface 12. The weights 22 may be either integral (as shown in FIG. 1), or peripheral attachments provided. It is envisioned that at least one of the plurality of weights is provided in each corner of the playing surface 12. When the lubricating means 20 is introduced to the conduit 16, the weight of the lubricating means 20 will provide securement of the apparatus 10 and works in conjunction with the plurality of weights 22 to firmly secure the apparatus 10 and avoid movement of the apparatus 10 due to playing conditions, wind or other environmental factors. In an alternative embodiment, eyelets 64 (see FIG. 8) are provided about the perimeter of the playing surface 12. Implantable stakes 64, such as a linearly elongated stake, rod, dowel, wire or other similar means, are driven through the eyelets 64 and into the terrain to which the apparatus 10 and playing surface 12 are secured.

Referring now to FIG. 8*a*, FIG. 8*b*, FIG. 8*c* and FIG. 8*d*, a baseball or softball tee 70 is optionally included for those participants that do not possess the necessary skill level to hit a moving ball. Furthermore, the tee 70 may be necessary when the number of players available is limited. The tee 70 preferably has a planar base 72 and a telescopic stem 74 for adjusting the hitting height of the ball cup 76 positioned at the end of the stem 74. A net 80 may optionally be provided to be stationed behind home base 38 to help speed the instruction and/or game along in an efficient and safe manner. The net 80 preferably has an arched top 82, a strong and resilient netting material 84, and a frame 86 with a pair of elongated arms and having at least one securement stake 88, but preferably two securement stakes 88'. A plastic bat 90 and a plurality of plastic balls 92 may be included. The bat 90 is linearly elongated, having a wider circumference about the barrel of the bat 90 than the handle. The balls 92 may have a variety of forms, including solid plastic, solid plastic with simulated baseball seems fabricated into the plastic, or balls having a plurality of apertures, such as WIFFLE® balls.

It is envisioned that the apparatus 10 may include a kit containing the apparatus 10, at least one plastic bat 90 and at least one plastic ball 92, wherein a plurality of plastic balls 92 are preferred to reduce gaps in action. In one embodiment, three plastic balls 92 are provided. Other variations of such a kit might include the optional tee 70, and/or the optional net 80.

2. Operation of the Preferred Embodiment

To use the present invention, a user will place the apparatus 10 on a surface, such as a field with natural grass, artificial grass, dirt, rubber or another suitable surface, and secure the apparatus 10 appropriately. If the apparatus 10 is provided with eyelets 64, the playing surface 12 must be secured to the terrain or surface via stakes 66 driven through the eyelets 64, otherwise the integral weights 22 will provide the necessary securement. If necessary, first base 40, second base 42 and third base 44 are attached to the playing surface 12. The user will then connect a source 30 of the lubricating means 20 (envisioned to be water from a water hose connection) to the inlet port 28 by either a threadable coupling or frictional impingement. The source 30 is activated, and the lubricating means 20 is pumped through the conduit 16 (and optionally second conduit 62) and integral pin holes 18 to provide an enhancement to the already slipper flexible plastic playing surface 12.

The apparatus 10 may be used by a single participant to perform instructional drills in relation to base sliding techniques. When used for instructional drills, there is no limit as to the number of participants that may drill and enjoy the apparatus 10. By way of example only, and in no way limiting the claims of the present invention, four base sliding stations may be set-up in which one station is home base 38 to first base 40, a second station is first base 40 to second base 42, a third station is second base 42 to third base 44, and a fourth station is third base 44 to home base 38. Conceivably, each of the aforementioned stations might be directed to a different aspect of the varying base sliding techniques used at different levels of organized baseball. By way of further example, and not limiting the claims, the first station may be directed to feet-first sliding in which the feet will touch first base 40. The second station may be directed to feet-first sliding in which the feet slide to the side of second base 42 and the participant reaches out to touch the base with a hand or hands. The third station may be directed at head-first sliding in which the hand or hands touch third base 44. The fourth station may be directed at head-first sliding in which the participant slides wide of the base and then reaches out to touch the base, thus simulating avoidance of a tag on a head-first slide. As is apparent, the myriad of possibilities for use of the apparatus 10 for base sliding drills and/or games are limitless.

3. Method of Playing a Game Using the Preferred Embodiment

In addition to use as an instructional drill device, the apparatus 10 may also be used to play a modified version of baseball and/or softball, obviously reduced in scale to accommodate the relative dimensions of the apparatus 10 and the playing surface 12. The modified version of baseball and/or softball provides an interesting and fun alternative to the repetitive nature of instructional drilling, and further provides the participants the opportunity to see the results of the instructional drilling sessions and gage participant progression.

To play the modified version of baseball and/or softball in accordance with the preferred embodiment of the apparatus 10 disclosed, a minimum number of two players and of six players are allowed per side. For purposes of clarity, the example provided uses the maximum number of eight players per side. Eight players from a team take to the playing surface to play defense, with the defense having a catcher, a pitcher, a first baseman, a second baseman, a third baseman, and three outfielders, with the three "outfielders" positioned just beyond the diamond indicia 14, but still on the playing surface 12. The other team bats using the plastic bat provided. The pitcher may pitch a solid plastic ball or WIFFLE® ball either overhanded or underhanded, depending upon the hitting skills of the participants. The pitcher delivers a pitch to the batter. A batter may (1) get a hit, (2) get an out—either from a fly ball caught in the air by an opposing fielder, or by grounding out and being either tagged or "forced out" by the opposing fielder's throw to the base the batter is running to, or (3) strike out—three strikes assessed against the batter during one at-bat.

A batter swinging, but missing, the pitch is accessed a "strike" against the batter's at-bat. A batter that does not swing is not accessed a "ball" as is customary in baseball, but remains at-bat. A batter that hits a ball in the air that is caught by the opposing fielders is called "out." A batter that hits a ball on the ground but is not tagged or "forced out" by the opposing fielder's throw is "safe" at the base to which the batter is positioned. The batter then becomes a "base runner" and the next participant in the batting order becomes the "batter." A batter that hits the ball in the air, but off of the playing surface 12, regardless of direction, is assessed a "strike" against the batter's at-bat. This is to reduce the risk of injury that might occur if the fielders were to chase after balls hit from the playing surface.

Three strikes equal one out. Three outs equal a half-inning. Six outs, with three outs to one team and three outs to the opposing team, equal an inning. A predetermined limit of innings is set-out at the beginning of the game.

Runs are scored in a fashion similar to baseball and/or softball, with a run credited to a team if a batter and/or runner reaches home base 38 without being tagged out or forced out by the opposing fielders.

Optionally, this modified game may require all batters to slide into the respective base to which the batter/runner is approaching, thus incorporating the instructional element from the drills previously mentioned.

In addition, the tee 70 previously mentioned may be used to accommodate participants having poor skills in hitting a moving ball. Furthermore, the net 80 previously mentioned may be used as a backstop to home base 38, thus providing a means for stopping pitches that are not hit and therefore speeding the pace of play (if necessary). Finally, the net 80 may also be used to provide a substitute "participant." For instance, and not by way of limiting the claims, a net 80 may be used to "force out" or "tag out" a base runner approaching home base 38 if the thrown ball hits the net 80 before the base runner touches home base 38.

The foregoing description is included to illustrate the operation of the preferred embodiment and is not meant to limit the scope of the invention. The scope of the invention is to be limited only by the following claims.

What is claimed is:

1. An apparatus for teaching baseball and softball base sliding techniques, said apparatus comprising:

an elongated playing surface that substantially conforms to the terrain secured thereto, said playing surface comprising a flexible plastic;

diamond indicia comprising a home base, a first base, a second base, a third base and a pitching rubber, wherein at least said home base and said pitching rubber are integral to said playing surface, said diamond indicia arranged to substantially conform to the rules of baseball and softball;

a lubricating conduit linearly elongated about four-sides to substantially circumscribe said diamond indicia, wherein said conduit comprises a plurality of pin holes for circulation of lubricating means to said playing surface;

a plurality of weights arranged about a perimeter of said playing surface; and an inlet port integral to said conduit, said inlet port connecting with a source of said lubricating means.

2. The apparatus of claim 1, wherein said playing surface comprises polyethylene.

3. The apparatus of claim 1, wherein said playing surface comprises vinyl reinforced with elastomers to provide added structural strength.

4. The apparatus of claim 1, wherein said playing surface comprises:

a top layer, said top layer comprising a flexible plastic material;

a bottom layer, said bottom layer comprising a flexible plastic material, said bottom layer affixed to said top layer; and a cushioning member intermediate to said top layer and said bottom layer.

5. The apparatus of claim 4, wherein said cushioning member is a member selected from the group consisting of air, gel, foam, and buckwheat.

6. The apparatus of claim 1, wherein said first base, said second base and said third base are integral to said playing surface.

7. The apparatus of claim 1, wherein said first base, said second base and said third base are detachably removable from said playing surface.

8. The apparatus of claim 7, wherein said first base, said second base and said third base each comprise a flexible plastic exterior and a padded interior.

9. The apparatus of claim 1, wherein said lubricating conduit and said plurality of pin holes are integral to said playing surface.

10. The apparatus of claim 9, wherein said plurality of pin holes each further comprise a directional baffle, said baffle providing a misting effect.

11. The apparatus of claim 1, wherein said lubricating means is a water-based solution.

12. The apparatus of claim 1, wherein said plurality of weights are heavier in mass than the material of said playing surface, said plurality of weights integral to said playing surface.

13. The apparatus of claim 1, wherein said plurality of weights are heavier in mass than the material of said playing surface, said plurality of weights are peripheral attachment for insertion through a plurality of eyelets provided along the perimeter of said apparatus.

14. The apparatus of claim 1, wherein said inlet port is formed at a margin of said apparatus, said inlet port comprising a series of internal threads provided to receive external threads formed on said source of lubricating means.

15. The apparatus of claim 1, wherein said inlet port is formed at a margin of said apparatus, said inlet port comprising a tapered body with a wide opening and a narrowed internal end to mechanically and frictionally impinge said source of lubricating means.

16. The apparatus of claim 1 further comprising a baseball or softball tee, wherein said tee is telescopically adjustable, said tee comprising:

a planar base;

a telescopic stem, said stem terminating at two ends, wherein one of said ends is affixed to said planar base; and a ball cup, said ball cup affixed to an opposite said end of said stem, said ball cup for housing a plastic ball.

17. The apparatus of claim 1 further comprising a net, said net placed behind home plate for aiding the efficiency of instruction or game play, said net comprising:

a frame, said frame having a pair of elongated arms;

a resilient netting material, said netting material affixed to said frame; and at least one securement stake, said stake provided at bottom of said frame for implanting of said stake into the ground.

18. The apparatus of claim 1 further comprising at least one plastic bat and at least one plastic ball.

19. The apparatus of claim 1 further comprising a second lubricating conduit provided along a linear line between said home base and said pitching rubber, thereby providing lubricating means to said playing surface between said home base and said pitching rubber.

* * * * *